US009772592B2

(12) United States Patent
Shirafuji

(10) Patent No.: US 9,772,592 B2
(45) Date of Patent: Sep. 26, 2017

(54) IMAGE FORMING APPARATUS

(71) Applicant: CANON KABUSHIKI KAISHA, Tokyo (JP)

(72) Inventor: Yasuhito Shirafuji, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/856,225

(22) Filed: Sep. 16, 2015

(65) Prior Publication Data

US 2016/0085196 A1 Mar. 24, 2016

(30) Foreign Application Priority Data

Sep. 18, 2014 (JP) ..... 2014-190114

(51) Int. Cl.
*G03G 15/00* (2006.01)

(52) U.S. Cl.
CPC ..... *G03G 15/556* (2013.01); *G03G 15/5041* (2013.01)

(58) Field of Classification Search
None
See application file for complete search history.

(56) References Cited

U.S. PATENT DOCUMENTS

2004/0170442 A1 9/2004 Forbes
2004/0197110 A1 10/2004 Bessho
2013/0016371 A1* 1/2013 Tanaka ..... H04N 1/40 358/1.9
2013/0195485 A1* 8/2013 Ueno ..... G03G 15/161 399/53

FOREIGN PATENT DOCUMENTS

| | | | |
|---|---|---|---|
| EP | 0487009 | A2 | 5/1992 |
| EP | 0604941 | A2 | 7/1994 |
| EP | 2418839 | A1 | 2/2012 |
| EP | 2458447 | A2 | 5/2012 |
| JP | 2003-263027 | A | 9/2003 |

* cited by examiner

*Primary Examiner* — Thomas Giampaolo, II
(74) *Attorney, Agent, or Firm* — Canon U.S.A., Inc. IP Division

(57) ABSTRACT

An image forming apparatus includes a conversion unit that converts image data based on a conversion condition, an image forming unit that forms an image based on the converted image data, a measurement unit that measures a measuring image, and a generation unit that controls the image forming unit to form a first measuring image while the image forming unit is continuously forming images, and generates the conversion condition based on first measurement data of the first measuring image and a first feedback condition. The generation unit controls the image forming unit to form a second measuring image during a period from when toner discharge processing has been performed until the image forming unit forms a subsequent image, and generates the conversion condition based on second measurement data of the second measuring image, and a second feedback condition with a larger correction amount than the first feedback condition.

9 Claims, 14 Drawing Sheets

IMAGE FORMING APPARATUS

BACKGROUND OF THE INVENTION

Field of the Invention

The present invention relates to density adjustment control.

Description of the Related Art

An electrophotographic image forming apparatus forms an electrostatic latent image on a photosensitive member based on image data, and develops the electrostatic latent image using developer in a development device to thereby form an image. The development device frictionally charges the developer in the development device to thereby change the charge amount of the developer. It is known that a density of an image formed by an image forming apparatus changes depending on the charge amount of developer in a development device. When the charge amount of the developer decreases, the density of the image formed by the image forming apparatus becomes higher. On the other hand, when the charge amount of the developer increases, the density of the image formed by the image forming apparatus becomes lower.

It is important for the electrophotographic image forming apparatus to control the charge amount of the developer in the development device to be a target value in order to form an image with a desired density. However, when, for example, the image forming apparatus forms a plurality of images at low toner consumption, the consumed developer is slight and the developer contained in the development device thus can be excessively charged.

Therefore, when the charge amount of developer increases due to an image having been formed at low toner consumption, an image forming apparatus described in Japanese Patent Application Laid-Open No. 2003-263027 forcibly discharges the developer to thereby decrease the charge amount of the developer contained in a development device. The image forming apparatus forms an electrostatic latent image in an area where, on a photosensitive member, an image is not formed, and develops the electrostatic latent image by use of the developer to thereby form a pattern image which is to be used for discharging the developer. The pattern image is not transferred onto a recording material but is cleaned by a cleaning member. Even when the charge amount of the developer in the development device excessively increases, the image forming apparatus can decrease the amount of the developer in the development device by forming a pattern image and discharging the developer, and further can decrease the charge amount of the developer in the development device due to new toner supplied to the development device.

SUMMARY OF THE INVENTION

A first aspect of the present invention is directed to an image forming apparatus including an image bearing member, a conversion unit configured to convert image data based on a conversion condition, an image forming unit including a container configured to contain toner, and configured to form an image based on the converted image data using toner in the container, a controller configured to perform toner discharge processing by performing control to cause the image forming unit to discharge the toner in the container therefrom and supplying the container with toner, a measurement unit configured to measure a measuring image formed on the image bearing member by the image forming unit, and a generation unit configured to generate the conversion condition based on measurement data corresponding to the measuring image measured by the measurement unit, wherein the generation unit causes the image forming unit to form a first measuring image on the image bearing member while the image forming unit is continuously forming a plurality of images, and generates the conversion condition based on first measurement data corresponding to the first measurement image measured by the measurement unit, and a first feedback condition, and wherein the generation unit causes the image forming unit to form a second measuring image on the image bearing member during a period from when the controller has performed the toner discharge processing until when the image forming unit forms the image, and generates the conversion condition based on second measurement data corresponding to the second measuring image measured by the measurement unit, and a second feedback condition with a larger correction amount than the first feedback condition.

Other aspects and further preferred features of embodiments of the present invention will become apparent from the following description of exemplary embodiments with reference to the attached drawings.

DESCRIPTION OF THE EMBODIMENTS

A first exemplary embodiment according to the present invention will be first described.

Figure 1:
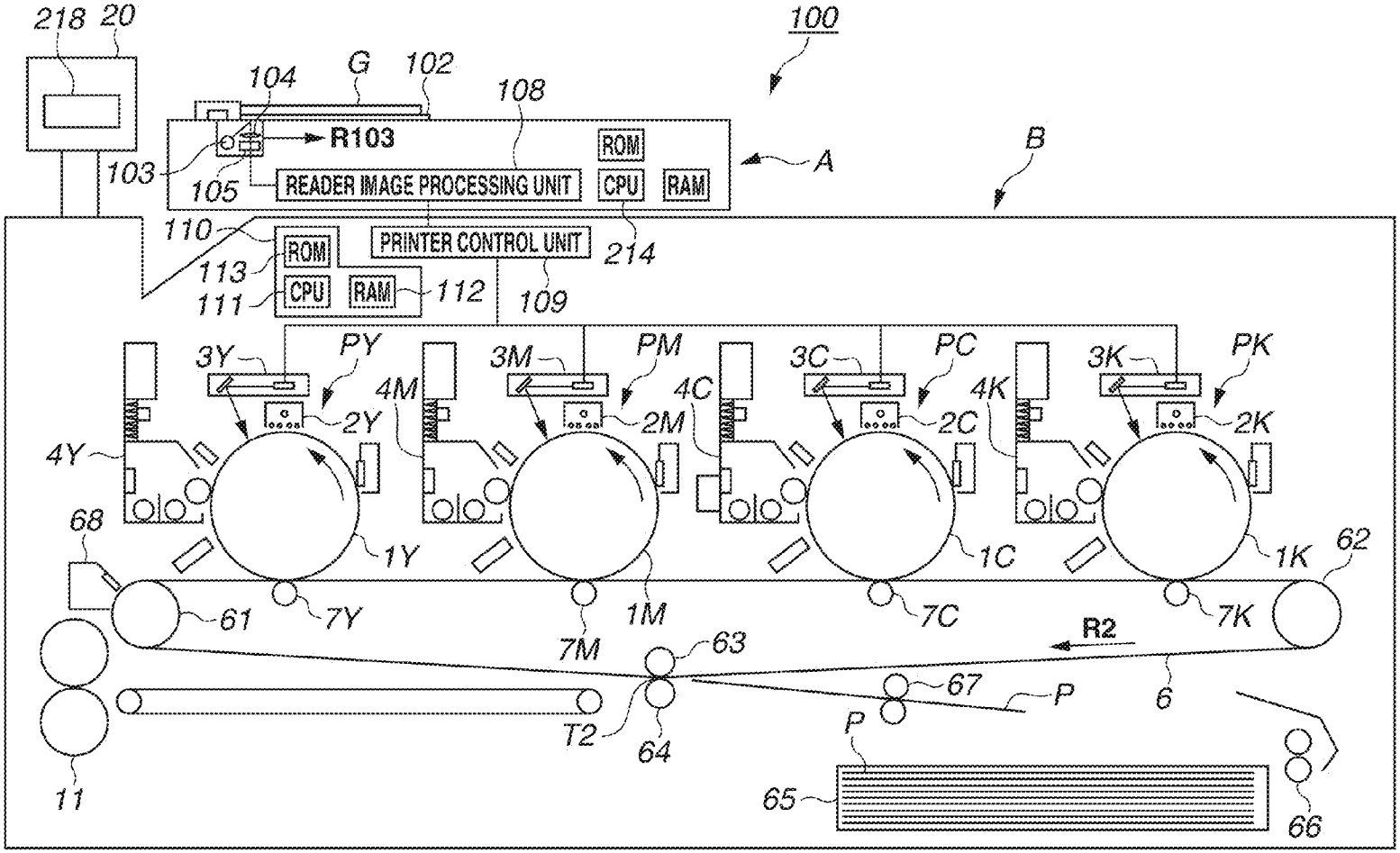
FIG. 1 is a schematic cross-section view of an image forming apparatus.

As illustrated in FIG. 1, an image forming apparatus 100 is a full-color printer in which yellow, magenta, cyan, and black image forming units PY, PM, PC, and PK are arranged along an intermediate transfer belt 6.

A yellow-component toner image is formed on a photosensitive drum 1Y at the image forming unit PY and is transferred onto the intermediate transfer belt 6. A magenta-component toner image is formed on a photosensitive drum 1M at the image forming unit PM and is transferred onto the intermediate transfer belt 6 in such a way as to overlap the yellow-component toner image. A cyan-component toner image and a black-component toner image are formed on a photosensitive drum 1C at the image forming unit PC and a photosensitive drum 1K at the image forming unit PK, respectively, and are sequentially transferred onto the intermediate transfer belt 6 in such a way as to overlap the magenta-component toner image transferred onto the intermediate transfer belt 6. Thereby, a full-color toner image is carried by the intermediate transfer belt 6.

The full-color toner image carried by the intermediate transfer belt 6 is conveyed to a secondary transfer unit T2 and transferred from the intermediate transfer belt 6 to a recording material P. When the recording material P to which the full-color toner image has been transferred is conveyed to a fixing device 11, the fixing device 11 melts the toner image carried by the recording material P and fixes the toner image on the recording material P using heat and pressure of a fixing member. Then, the recording material P on which the toner image has been fixed is discharged from the image forming apparatus 100.

The intermediate transfer belt 6 is supported across a tension roller 61, a drive roller 62, and an opposing roller 63, and is driven by the drive roller 62 to rotate in an arrow R2 direction at a predetermined speed.

The recording materials P fed from a recording material cassette 65 are separated one by one by a separation roller 66, and then sent forth to a registration roller 67. The registration roller 67 controls a conveyance speed or a conveyance timing of the recording materials P to adjust a time at which the toner image carried by the intermediate transfer belt 6 reaches the secondary transfer unit T2 and a time at which the recording material P reaches the secondary transfer unit T2.

A secondary transfer roller 64 abuts the intermediate transfer belt 6 supported by the opposite roller 63 to thereby form the secondary transfer unit T2. When a positive direct current (DC) voltage is applied to the secondary transfer roller 64, the toner image negatively charged and carried by the intermediate transfer belt 6 is secondarily transferred to the recording materials P.

The image forming units PY, PM, PC, and PK have substantially the same structure except that the toner colors contained in the development devices 4Y, 4M, 4C, and 4K are yellow, magenta, cyan, and black, respectively, and are thus different from one another. The subscripts Y, M, C, and K are omitted for the following description unless any distinction is to be made among them.

At the image forming unit P, a charging device 2, an exposure device 3, a development device 4, a primary transfer roller 7, a cleaning device 8 (FIG. 2) are arranged around the photosensitive drum 1.

The photosensitive drum 1 is formed by arranging a photosensitive layer (photosensitive member) having a negative charge polarity on an outer periphery of an aluminum cylinder, and is driven to rotate in an arrow R1 (FIG. 2) direction at a predetermined speed. The photosensitive drum 1 is an OPC photosensitive member with a reflectivity of about 40% of a near-infrared light (960 nm). However, an amorphous silicon-based photosensitive member with a comparable reflectivity may be employed.

The charging device 2 uses a scorotron charger, and uniformly charges the surface of the photosensitive drum 1 at a negative potential. A predetermined charge bias is applied from a charge bias power supply (not illustrated) to a wire of the charging device 2. A predetermined grid bias is applied from a grid bias power supply (not illustrated) to a grid part of the charging device 2.

The exposure device 3 irradiates the photosensitive drum 1 with a light beam in order to form an electrostatic latent image on the charged surface of the photosensitive drum 1. The exposure device 3 functions as a latent image forming unit that forms an electrostatic latent image on the photosensitive drum 1. The development device 4 attaches toner to the electrostatic latent image of the photosensitive drum 1 and develops the electrostatic latent image provided with toner to obtain a toner image.

The primary transfer roller 7 presses the intermediate transfer belt 6, and forms a primary transfer portion T1 (FIG. 2) between the photosensitive drum 1 and the intermediate transfer belt 6. When the primary transfer roller 7 is applied with a transfer voltage, the negative toner image carried by the photosensitive drum 1 is transferred to the intermediate transfer belt 6 at the primary transfer unit T1.

The cleaning device 8 has a cleaning blade that rubs the photosensitive drum 1, and cleans the toner remaining on the photosensitive drum 1 without being transferred from the photosensitive drum 1 to the intermediate transfer belt 6.

A cleaning device 68 has a cleaning blade that rubs the intermediate transfer belt 6, and cleans the toner remaining on the intermediate transfer belt 6 without being transferred from the intermediate transfer belt 6 to the recording material P.

The image forming apparatus 100 is provided with an operation unit 20. The operation unit 20 has a liquid crystal display 218. The operation unit 20 is connected to a central processing unit (CPU) 214 in a reader unit A and a control unit 110 in the image forming apparatus 100. A user can input print conditions such as the number of pages to be printed of an image, or designation of double-sided printing or single-sided printing via the operation unit 20. A printer unit B performs image formation processing based on print information input via the operation unit 20.

Figure 2:
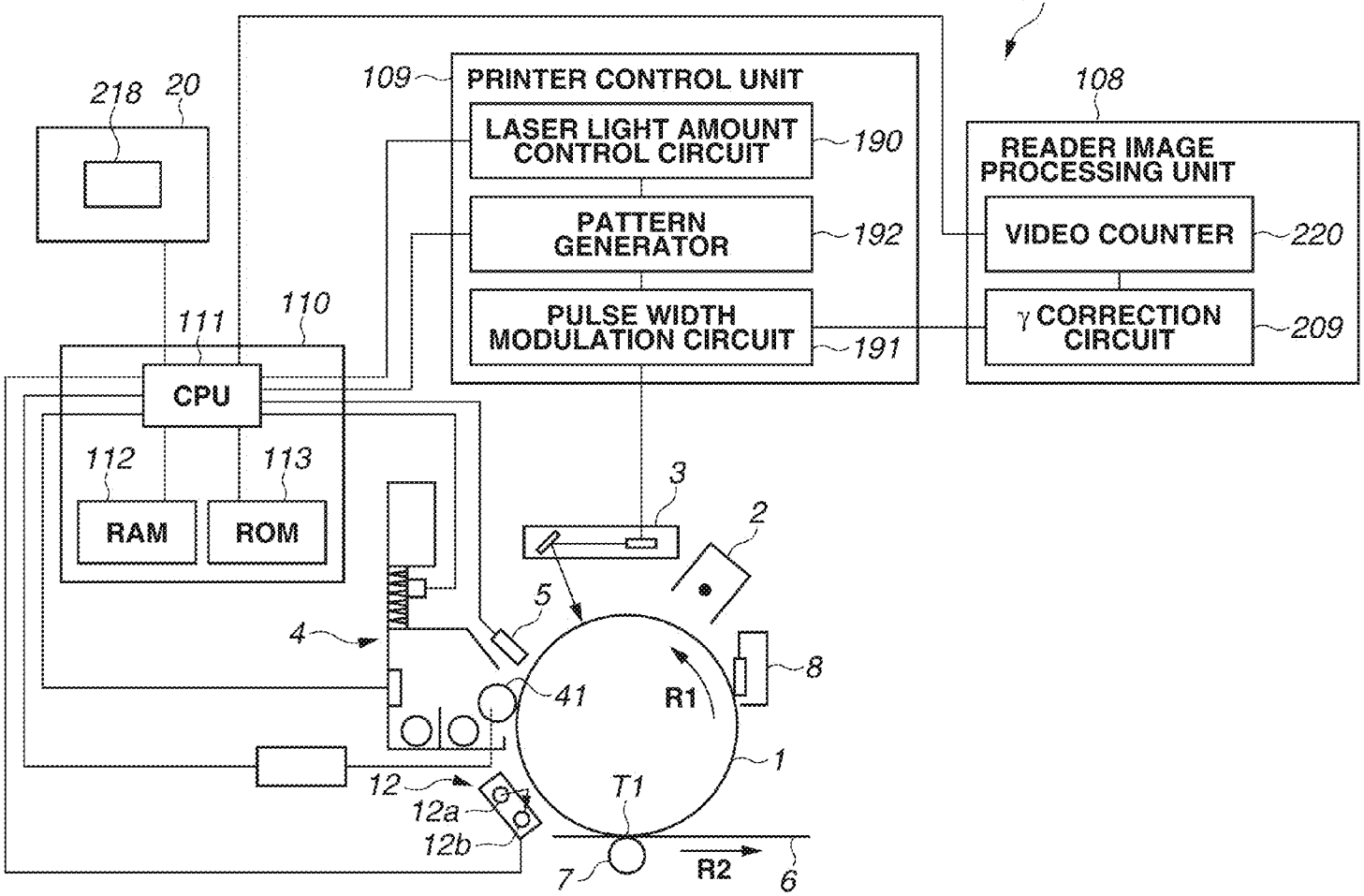
FIG. 2 is a control block diagram of the image forming apparatus.

FIG. 2 is a control block diagram of the image forming apparatus. As illustrated in FIG. 2, the image forming apparatus 100 has the control unit 110 that integrally controls the image formation processing. The control unit 110 has a CPU 111, a random access memory (RAM) 112, and a read only memory (ROM) 113. A potential sensor 5 detects a potential of an electrostatic latent image formed on the photosensitive drum 1 by the exposure device 3.

A laser light amount control circuit 190 determines an intensity of the light beam emitted from the exposure device 3. The exposure device 3 controls drive power for driving a semiconductor laser such that an intensity of the semiconductor laser of the exposure device 3 becomes equal to the intensity determined by the laser light amount control circuit 190. A γ correction circuit 209 converts an input image signal included in image data input via the reader unit A or an input image signal included in image data transferred via an interface into an output image signal with reference to a gradation correction table (LUT). Here, the gradation correction table functions as a conversion condition for converting image data. A correspondence between an output image signal and a density level is stored as a gradation correction table (LUT) in a memory (not illustrated).

A pulse width modulation circuit 191 outputs a laser drive signal based on the output image signal output from the γ correction circuit 209. The semiconductor laser of the exposure device 3 controls an exposure time (blinking timing) of a light beam according to the laser drive signal. The image forming apparatus 100 forms an image by use of an area gradation method, and thus the exposure device 3 controls an exposure time of a light beam so that a density of an image formed by the image forming unit P is controlled. Thus, with the semiconductor laser, the exposure time on high-density pixels is longer than the exposure time on low-density pixels.

(Reader Unit A)

The reader unit A (FIG. 1) will be described below. A reflection light with which a light source 103 irradiates a document G placed on a document table 102 is focused onto a charge-coupled device (CCD) sensor 105 via an optical system 104 such as lens. A unit having the light source 103, the optical system 104, and the CCD sensor 105 moves in an arrow R103 direction to thereby read the document G.

When a reflection light from the document G is focused onto the CCD sensor 105, luminance data indicating a reading result of the document G is obtained. A reader image processing unit 108 converts the luminance data into density data (image data) by use of a brightness/density conversion table (LUTid_r) stored in the ROM 113. The reader image processing unit 108 transfers the density data (image data) to a printer control unit 109. The printer control unit 109 performs image processing on the density data (image data) transferred from the reader image processing unit 108.

The image forming apparatus 100 forms an image based on image data received in a reception unit (not illustrated) via a telephone line or a network in addition to the image data read by the reader unit A.

(Photosensor)

The image forming unit P has a photosensor 12 downstream the development device 4 in a direction in which the photosensitive drum 1 rotates. The photosensor 12 has a light emission unit 12*a* that includes a light emitting element such as LED and a light reception unit 12*b* that includes a light receiving element such as photodiode (PD). When receiving a reflection light emitted from the light emission unit 12*a* and reflected from the photosensitive drum 1 or a measuring image formed on the photosensitive drum 1, the light reception unit 12*b* outputs a signal corresponding to an intensity of the received reflection light to the control unit 110. The light reception unit 12*b* outputs a voltage of which a value corresponds to the intensity of the received light (reflection light). The photosensor 12 is configured such that the light reception unit 12*b* receives only normal reflection lights. Here, the photosensitive drum 1 functions as an image bearing member that carries a measuring image.

Figure 3:
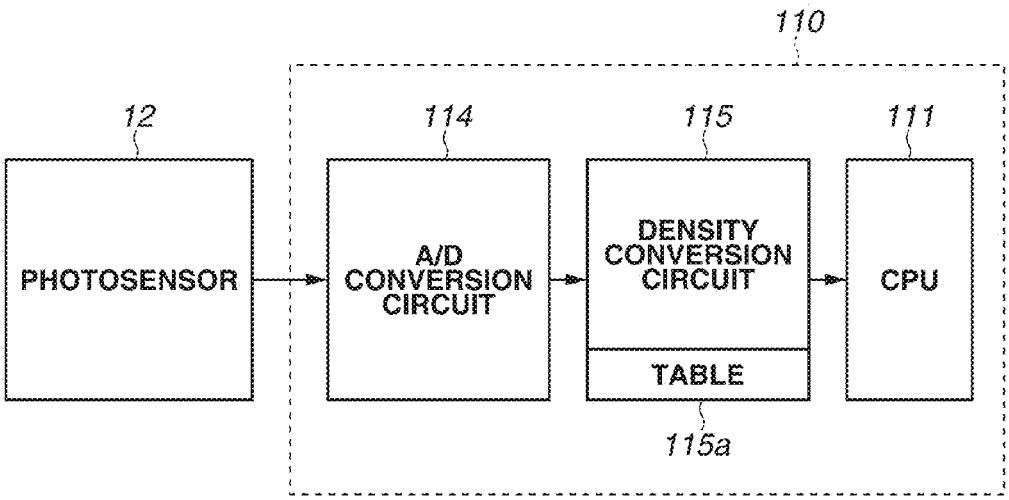
FIG. 3 is a block diagram illustrating a connection relationship between a photosensor and a control unit.

As illustrated in FIG. 3, a signal output from the light reception unit 12*b* in the photosensor 12 is converted into an 8-bit digital signal by an A/D conversion circuit 114 provided in the control unit 110. The digital signal is then converted into density data by a density conversion circuit 115 provided in the control unit 110. The density conversion circuit 115 previously stores therein a color-based dedicated table 115*a* used for converting an output signal from the photosensor 12 into a density signal of each color. Thereby, the CPU 111 can detect a density of a measuring image for each color.

When an image density of a measuring image formed on the photosensitive drum 1 is changed in a stepwise manner by area gradation, an output signal of the photosensor 12 varies depending on the density of the measuring image. When the toner is not adhered to the photosensitive drum 1, the output signal of the photosensor 12 is at 5V, and a digital signal value thereof is 255 level. The more the density of the measuring image formed on the photosensitive drum 1 increases, the more the value of the output signal of the photosensor 12 decreases and the converted digital signal value decreases.

(Measuring Image)

When continuously forming images corresponding to a plurality of items of image data, each of the image forming units PY, PM, PC, and PK forms a measuring image each time images for predetermined pages are formed.

Figure 4A:
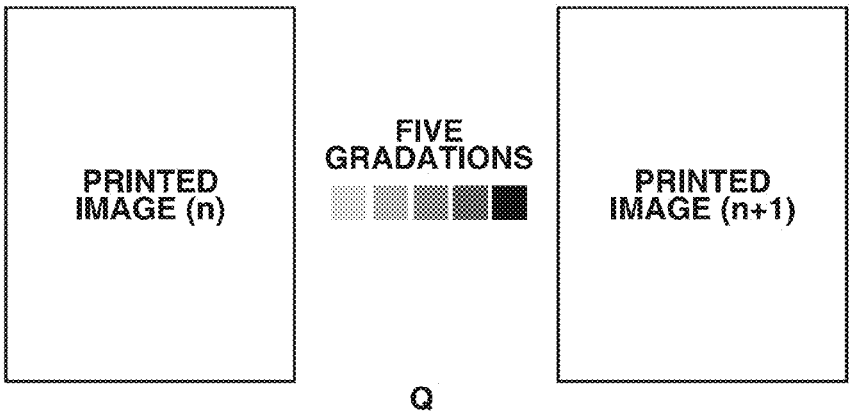
FIGS. 4A and 4B are diagrams illustrating measurement images formed on a photosensitive drum.
Figure 4B:
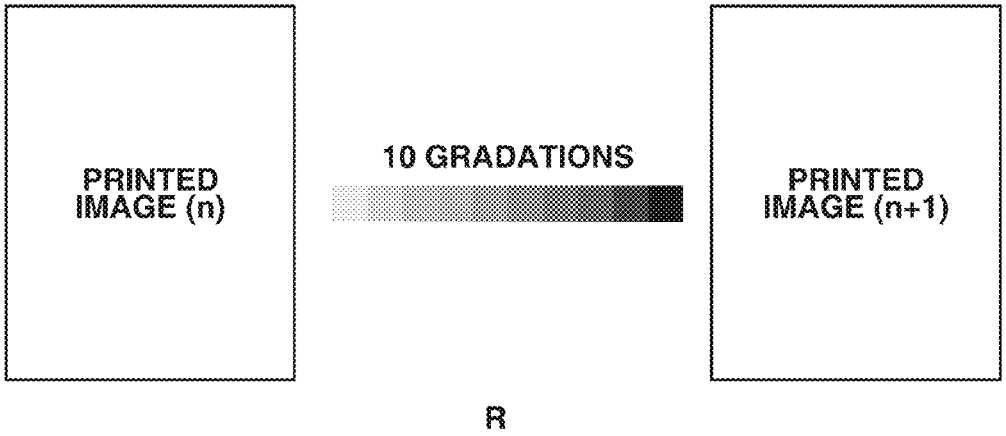

The control unit 110 performs control so that a measuring image is formed in a non-image area (at an image interval) sandwiched between images for every 100 pages during continuous image formation. FIG. 4A illustrates a measuring image Q formed on the photosensitive drum 1, and FIG. 4B illustrates a measuring image R formed on the photosensitive drum 1.

The control unit 110 controls the exposure device 3 to form an electrostatic latent image corresponding to the measuring image Q on the photosensitive drum 1, and causes the development device 4 to develop the electrostatic latent image, thereby forming the measurement image Q.

The control unit 110 performs image density control described below, and a gradation correction table (γLUT) is corrected such that each density of the measuring image Q is to be a target density previously set per measuring image Q based on a result of a measurement of the measuring image Q by the photosensor 12.

The printer control unit 109 is provided with a pattern generator 192 that generates an image signal (measuring image signal) at a predetermined signal level. A measuring image signal output from the pattern generator 192 is converted by the γ correction circuit, and then is input into the pulse width modulation circuit 191 and converted into a laser drive signal corresponding to the measuring image signal. The measuring image signal corresponds to the measuring image data.

The control unit 110 controls a semiconductor laser from the exposure device 3 based on the laser drive signal corresponding to the measuring image, and causes the exposure device 3 to expose the photosensitive drum 1. The development device 4 develops an electrostatic latent image corresponding to the measuring image on the photosensitive drum 1. Thereby, the measuring image is formed on the photosensitive drum 1.

(Toner Forcible Discharge Control)

When the charge amount of the developer contained in the development device 4 is larger than the target amount, the image forming unit P forms, on the photosensitive drum 1, a pattern image to be used for discharging the developer, and decreases the amount of developer in the development device 4. Thereby, the charge amount of the developer contained in the development device 4 is decreased. The image forming unit P forms a pattern image to be used for discharging the developer, and supplies the development device 4 with a low-charged developer, thereby further decreasing the charge amount of the entire developer contained in the development device 4.

The control unit 110 calculates an amount of consumed developer based on the image data each time an image is formed for predetermined pages (such as 1000 pages). When the amount of consumed developer per predetermined pages calculated based on the image data is smaller than the predetermined amount, it is determined that the developer in the development device 4 is highly charged. On the other hand, when the amount of consumed developer per predetermined pages calculated based on the image data is larger than the predetermined amount, it is predicted that the development device 4 is supplied with toner, and thus it is determined that the developer in the development device 4 is not highly charged. The control unit 110 functions as a determination unit that determines the amount of consumed developer in the development device. When the calculated consumption amount is smaller than the predetermined amount, the control unit 110 determines that the charge amount of the developer contained in the development device 4 is larger than the target amount.

When the charge amount of the developer contained in the development device 4 is larger than the target amount, the control unit 110 causes the image forming unit P to form a pattern image to be used for discharging the developer to thereby cause the developer in the development device 4 to be discharged such that the charge amount of the developer contained in the development device 4 is controlled to be the target amount. Since the quantity of the developer contained in the development device 4 decreases, the development device 4 can be newly supplied with developer. The control unit 110 newly supplies the development device 4 with developer from a supply unit, and controls the charge amount of the developer contained in the development device 4 to be the target amount.

There will be described below toner forcible discharge control for developing a pattern image to be used for discharging the developer, and for causing the cleaning device 8 to clean the pattern image to thereby cause the toner in the development device to be discharged therefrom. When any one of the image forming units PY, PM, PC, and PK meets a condition for performing the toner forcible discharge control, the control unit 110 controls all the image forming units PY, PM, PC and PK to stop the image formation operation, and to form a pattern image for discharging the developer.

When the image formation operation starts, the control unit 110 controls a video counter 220 in FIG. 2 to calculate the video count values V(Y), V(M), V(C), and V(K) of the respective colors for each page. The video counter 220 integrates image signal values, each obtained per pixel, included in the image data, and stores a value obtained by dividing the integrated value by an image size as a video count value. For example, when a solid image (with a printing ratio of 100%) is printed on either side of an A4-size recording material for one color, the video count value is assumed as 100.

When the number of printed pages reaches 1000 pages, the control unit 110 controls the video counter 220 to integrate the video count values V(Y), V(M), V(C), and V(K) for 1000 pages per color component, and calculates an average video count value Vt per color component. Equation (1) is directed to calculate an average video count value for one color component. When an average video count value is lower than a threshold Vth, the control unit 110 then performs the toner forcible discharge control.

$$Vt=\Sigma Vn/1000 \text{ where } n=1 \text{ to } 1000 \quad (1)$$

In the present exemplary embodiment, the threshold Vth is assumed as 1, for example. This indicates that when an image with a printing ratio of 1% is printed for 1000 pages, the charge amount of developer contained in the development device 4 becomes the target amount of the charge amount at which an image with a desired density can be formed. That is, when the video count value Vt is lower than 1, the image forming unit P cannot form an image with a desired density even if the gradation correction table is corrected. The threshold Vth may be experimentally determined in advance.

When the toner forcible discharge control is performed, the control unit 110 applies, to a primary transfer bias, a transfer bias having a polarity opposite to that of a transfer bias applied when forming an image based on image data transferred from the reader unit A or an external PC. Thereby, a pattern image to be used for discharging the developer is not transferred from the photosensitive drum 1 to the intermediate transfer belt 6.

The control unit 110 determines, with reference to a table indicating a relationship between a video count value Vt and a discharge amount, the amount of developer to be discharged corresponding to the video count value Vt calculated by the video counter 220. The table indicating the relationship between the video count value Vt and the discharge amount is experimentally determined, and is previously stored in the ROM 113. The control unit 110 then controls the image forming unit P to form a pattern image to be used for discharging the developer based on the predetermined discharge amount. The pattern image formed on the photosensitive drum 1 is recovered by the cleaning device 8. Then, when the discharge operation ends, the control unit 110 controls the primary transfer bias to be a positive bias and causes the image forming unit P to restart forming the image for the remaining pages to be printed.

In order to minimize a downtime due to the performed toner forcible discharge control, a pattern image to be used for discharging the developer is preferably a solid image spread in the entire photosensitive drum 1 in the longitudinal direction.

(Image Density Control)

Image density control according to the present exemplary embodiment will be described with reference to FIG. 5. The CPU 111 performs the image density control in FIG. 5 according to a program stored in the ROM 113.

The image density control is performed in the image forming units PY, PM, PC, and PK in the same way, and thus a description thereof for each image forming unit will be omitted.

The image density control is performed while a plurality of images are being continuously formed. The CPU 111 increments a value of a counter (not illustrated) that counts the number of printed pages by 1 each time when an image for one page is formed. In step S201, the CPU 111 determines whether the number of printed pages has reached 100 pages. In a case where a value of the counter has reached 100 (YES in step S201), the CPU 111 determines that the number of printed pages has reached 100 pages. Here, if the number of printed pages does not reach 100 pages (NO in step S201), the image density control is not performed.

On the other hand, when the number of printed pages has reached 100 pages (YES in step S201), in step S203, the CPU 111 controls the image forming unit P to form a test pattern (measuring images Q) represented by five gradations on the photosensitive drum 1. The measuring images Q each have a different gradation. A light emission intensity of a light beam used when the measuring images Q are formed is determined based on an environmental condition such as temperature or humidity measured by an environmental sensor provided in the image forming apparatus 100. In the measuring images Q included in the test pattern, measuring image data is corrected by the γ correction circuit 209 using a current gradation correction table so that the measuring image is formed based on the corrected image data. The test pattern includes a measuring image Qmax corresponding to a maximum value (with a signal level of 255) amount the 8-bit image signals.

Then, in step S204, the CPU 111 controls the photosensor 12 to measure a density of the test pattern (the measuring images Q) formed on the photosensitive drum 1. In step S205, the CPU 111 linearly interpolates a measurement result of each measurement image measured in step S204.

Figure 6:
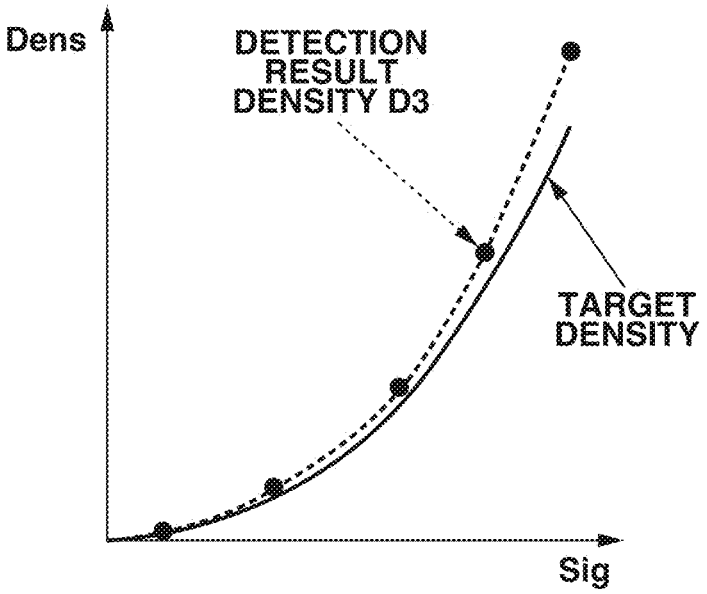
FIG. 6 is a graph illustrating a relationship between a measurement result and a target density of a measuring image.

FIG. 6 is a graph illustrating a relationship between a signal level of an image signal and a density of a measuring image Q measured by the photosensor 12. The solid line indicates a target density previously set per input signal level of an image signal. In FIG. 6, automatic gradation correction control described below is performed so that a target density is determined and stored in the RAM 112.

The CPU 111 then calculates a predictive density value using a difference between a measurement result and the target density, and a feedback rate. The predictive density value is calculated using Equation (2).

$$\text{Predictive density value}=(Yi'-Yi)\times(1-\text{feedback rate}/100)+Yi \quad (2)$$

Yi' indicates a target density when a signal level of an image signal is i, and Yi indicates a measurement result of a measuring image formed at the signal level i.

Further, the feedback rate is a correction coefficient indicating how much a measurement density is to be corrected relative to a target density. When a measurement density is converted into a target density, the feedback rate is assumed at 100%. In the image density control, the gradation correction table (LUT) is corrected while the image forming unit P is continuously forming images. Therefore, when the correction amount of the gradation correction table (LUT) increases, a change in density between an image formed before the image density control is performed and an image formed after the image density control is performed needs to be decreased. Thus, the feedback rate is set to be less than 100%. In the present exemplary embodiment, the feedback rate applied when the image density control is performed is set at 30%, for example.

Figure 5:
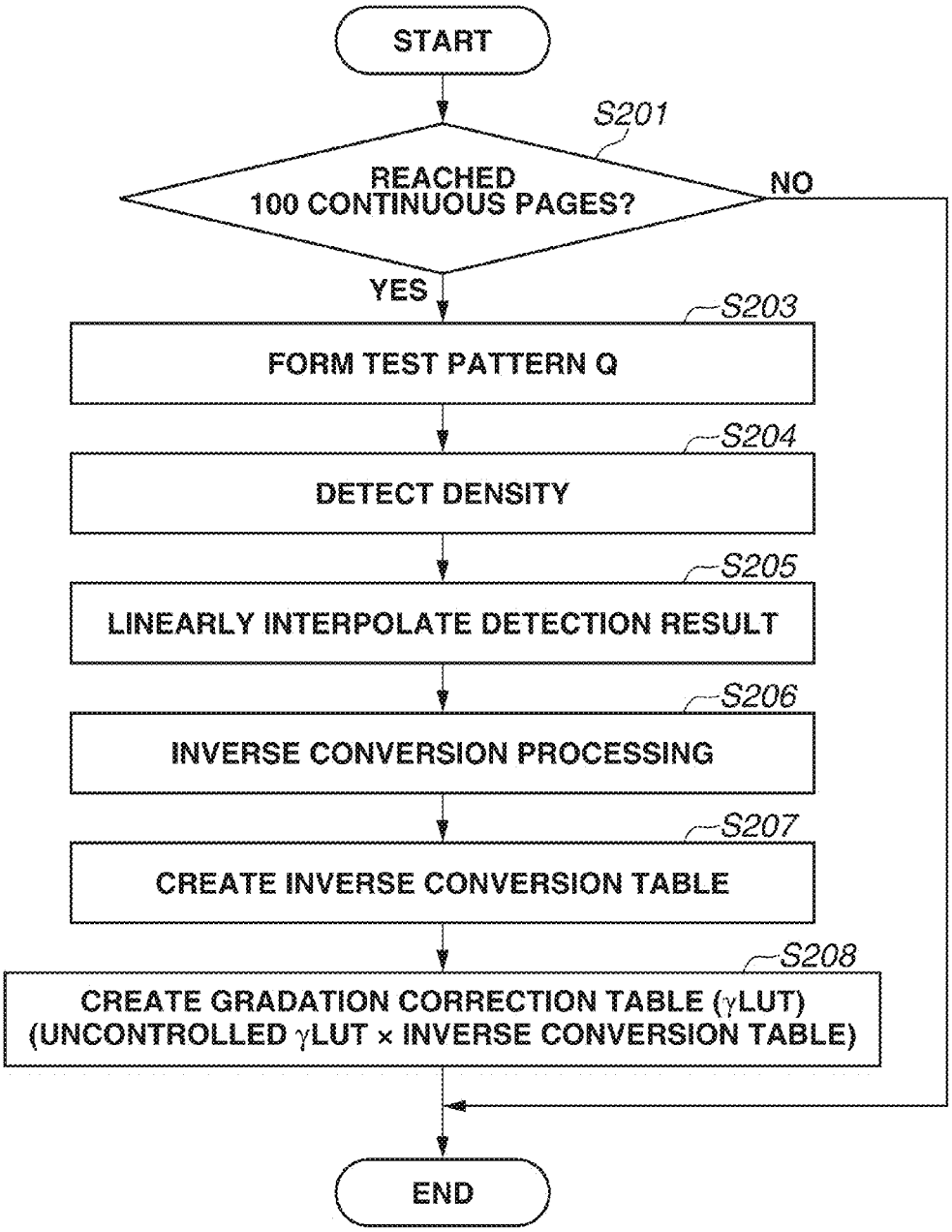
FIG. 5 is a flowchart illustrating image density control performed using the photosensor.

Returning to the description of the flowchart in FIG. 5. The CPU 111 makes inverse conversion calculation on the target density to enable the target density to be a proper density using the predictive density value and the target density value in step S206, and creates an inverse conversion table in step S207. In step S208, the CPU 111 updates the gradation correction table (LUT) using the inverse conversion table and the gradation correction table (LUT) before the image density control.

For the gradation correction table, a corresponding unconverted value in the inverse conversion table is specified and a converted value in the non-updated gradation correction table is replaced with a value obtained by converting the specified value. When an image signal with a signal level of 80 is converted into 100 in the gradation correction table and an image signal with a signal level of 100 in the inverse conversion table is converted into 105, the image signal with a signal level of 80 in the updated gradation correction table is converted into an image signal with a signal level of 105. A signal level without actually-measured data may be determined by performing linear interpolation on signal levels obtained based on actually-measured data.

The CPU 111 causes the memory of the γ correction circuit to store the updated gradation correction table and sets a value of the counter that counts the number of printed pages at 0, thereby terminating the image density control.

(Automatic Gradation Correction Control)

Figure 7:
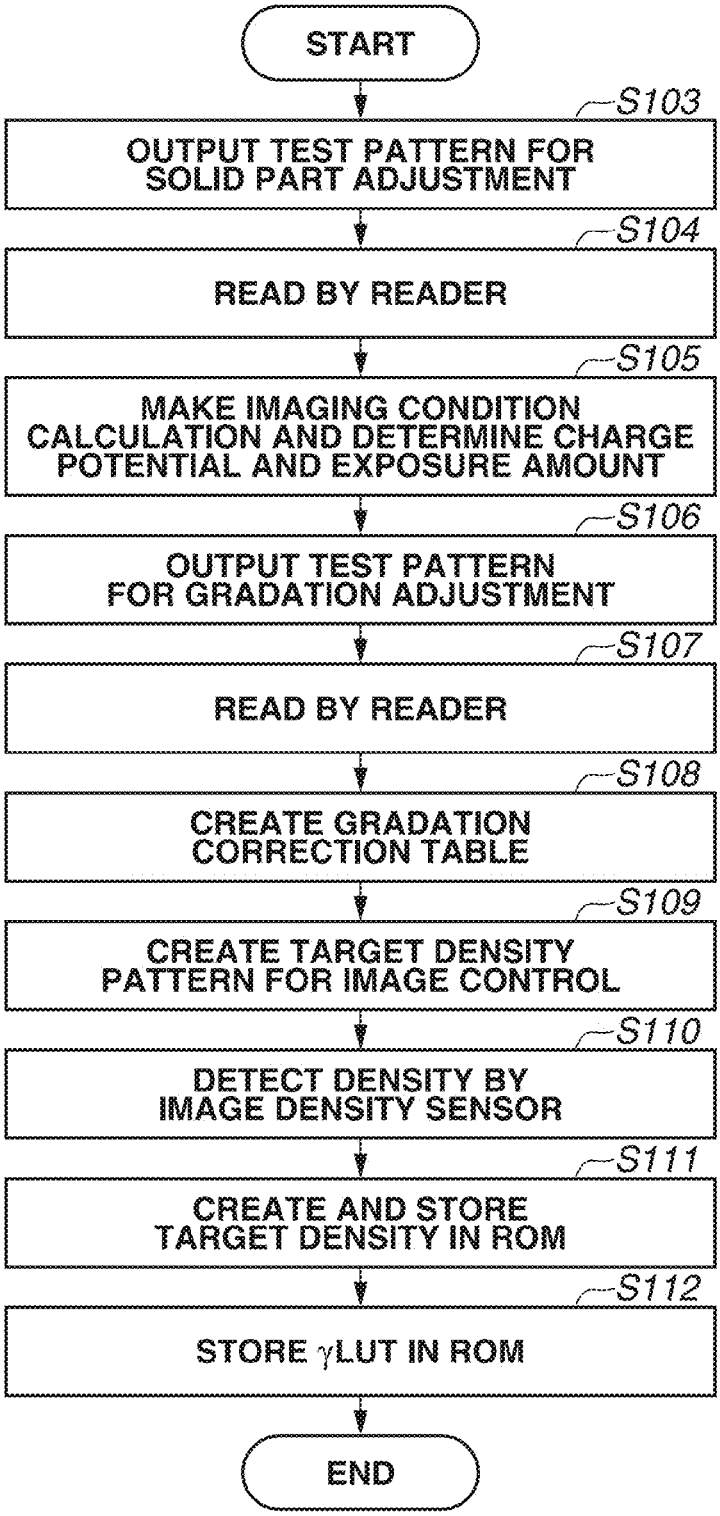
FIG. 7 is a flowchart illustrating automatic gradation correction control performed using a reader unit.
Figure 8:
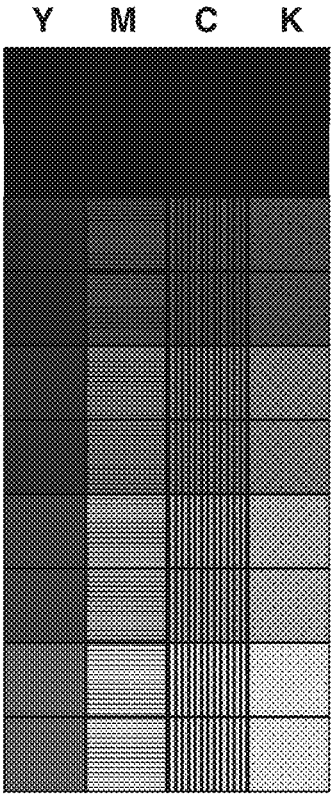
FIG. 8 is a diagram illustrating a test chart for setting a process condition.

FIG. 7 illustrates a flow of automatic gradation correction control. The CPU 111 executes automatic gradation correction illustrated in FIG. 7 according to the program stored in the ROM 113. When the automatic gradation correction is executed, in step S103, the CPU 111 forms, for each color component, an image pattern corresponding to a maximum value (255) of an image signal on a sheet while switching laser power of a light beam. FIG. 8 illustrates an image pattern formed on a sheet while changing laser power of a light beam in 10 levels.

The user causes the reader unit A to read the recording material P (test chart) on which the image pattern is formed. When the test chart is read by the reader unit A, in step S104, the CPU 111 obtains density information on each image pattern.

In step S105, the CPU 111 determines process conditions based on the obtained density information. Here, the process conditions are charge bias, development bias, and laser power (light intensity) of light beam. In the present exemplary embodiment, laser power (light intensity) of a light beam is determined as the process condition.

Figure 9:
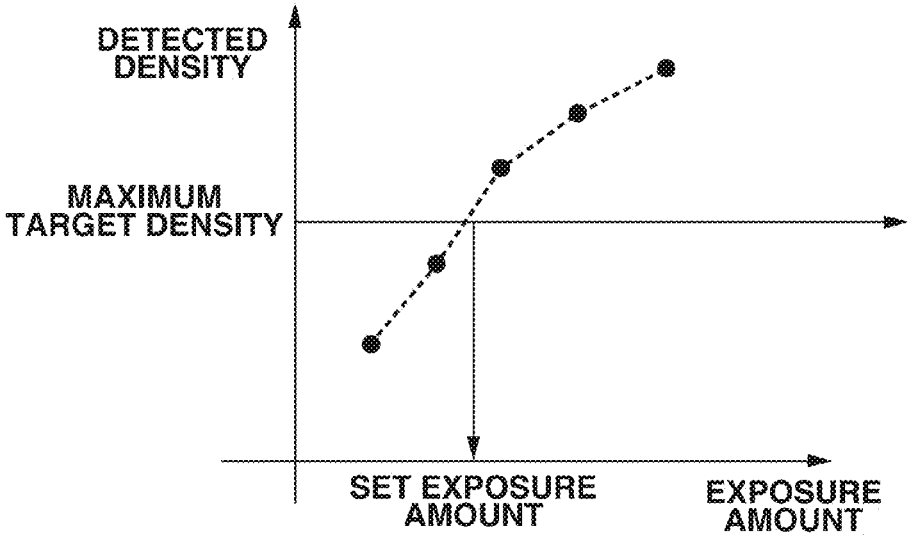
FIG. 9 is a graph illustrating results of reading of the test chart.

FIG. 9 is a graph illustrating the results obtained by measuring a density of an image pattern formed, using the image forming unit PY, by switching laser power. The horizontal axis indicates the exposure amount (laser power), and the vertical axis indicates a result obtained by measuring the density. The CPU 111 performs linear interpolation on each of measurement values, and determines laser power (set exposure amount) with which a density value set as a maximum density can be obtained.

Figure 10:
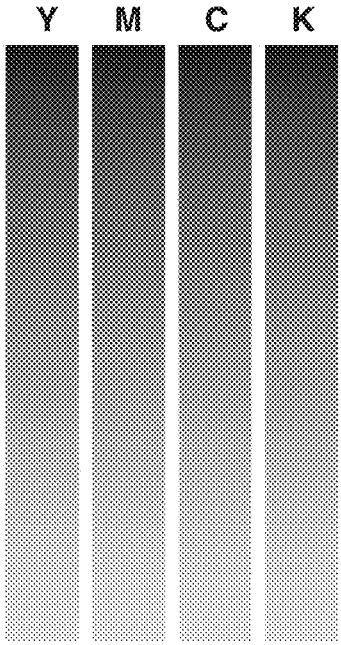
FIG. 10 is a diagram illustrating a test chart for generating a gradation correction table.

After the laser power is determined, the CPU 111 creates a gradation correction table. FIG. 10 illustrates an image pattern with 64 gradations, formed on a recording material P, which is used for creating the gradation correction table.

Returning to the description of the flowchart in FIG. 7. In step S106, the CPU 111 controls the image forming unit P to form an image pattern (FIG. 10) on a recording material P and discharge the recording material P. Then, as with the case of the test chart formed to be used for determining laser power, in step S107, the CPU 111 waits for the reading by the reading unit A, which is caused by the user, of the recording material P with the image pattern (FIG. 10) formed thereon to be completed.

Based on a result obtained from the reading by the reader unit A of the recording material P with the image pattern (FIG. 10) formed thereon, the CPU 111 obtains a γ property indicating a density per signal level of an image signal. In step S108, the CPU 111 creates a gradation correction table using the γ property and a target gradation previously stored in the ROM 113. The image forming apparatus achieves a desired density of an image formed on a recording material P by use of the gradation correction table created in step S108.

Next, a target density used for the image density control is determined. In step S109, the CPU 111 corrects measuring image data by use of the gradation correction table, and forms a test pattern (measuring images R) represented by 10 gradations illustrated in FIG. 4B on the photosensitive drum 1 based on the corrected image data. The measuring images R each have a different gradation. The image signals of measuring images R include the image signals of the measuring images Q.

The CPU 111 causes the photosensor 12 to measure the test pattern (the measuring images R) in step S110, and stores on the RAM 112 a measurement result of the test pattern (the measuring images R) as a target density in step S111. In step S112, the CPU 111 stores the gradation correction table created in step S108 on the RAM 112, and terminates the automatic gradation correction control. The gradation correction table stored on the RAM 112 in step S112 is used for forming the measuring images Q in the aforementioned image density control.

(Creation of Gradation Correction Table)

The CPU 111 performs image density control A in order to control a density of an image formed by the image forming unit P to be a desired density. A feedback rate in the image density control A is set at 30%. Besides, the CPU 111 performs image density control B only once after toner discharge has been performed. Thus, the CPU 111 performs the image density control A each time formation of an image has been performed for a predetermined number of pages since the CPU 11 performed the image density control B.

A feedback rate in image density control B performed after the toner forcible discharge control is performed is higher than the feedback rate in the image density control A performed per 100 printed pages illustrated in FIG. 5. This is because although the charge amount of developer contained in the development device 4 is controlled at the target amount after the toner forcible discharge control is performed, a conversion condition suitable for the high charge amount is set.

Specifically, the amount of toner contained in the development device 4 decreases after the toner forcible discharge control is performed, and thus the development device 4 is supplied with toner from the supply unit. The development device 4 is supplied with a low-charged developer the charge amount of developer contained in the development device 4 is thereby controlled at the target amount. However, the gradation correction table holds the data suitable for the amount of high-charged developer. Thus, even if image data is converted by use of a current gradation correction table, an image with a desired density cannot be formed. That is, a density of an image to be formed is higher than a desired density for the reason that the gradation correction table with which a density of an image becomes increased is set.

Thus, in a case where the toner forcible discharge control has been performed, the CPU 111 causes the supply unit to supply the development device 4 with toner, and then performs the image density control B at a feedback rate of 100%.

Figure 11:
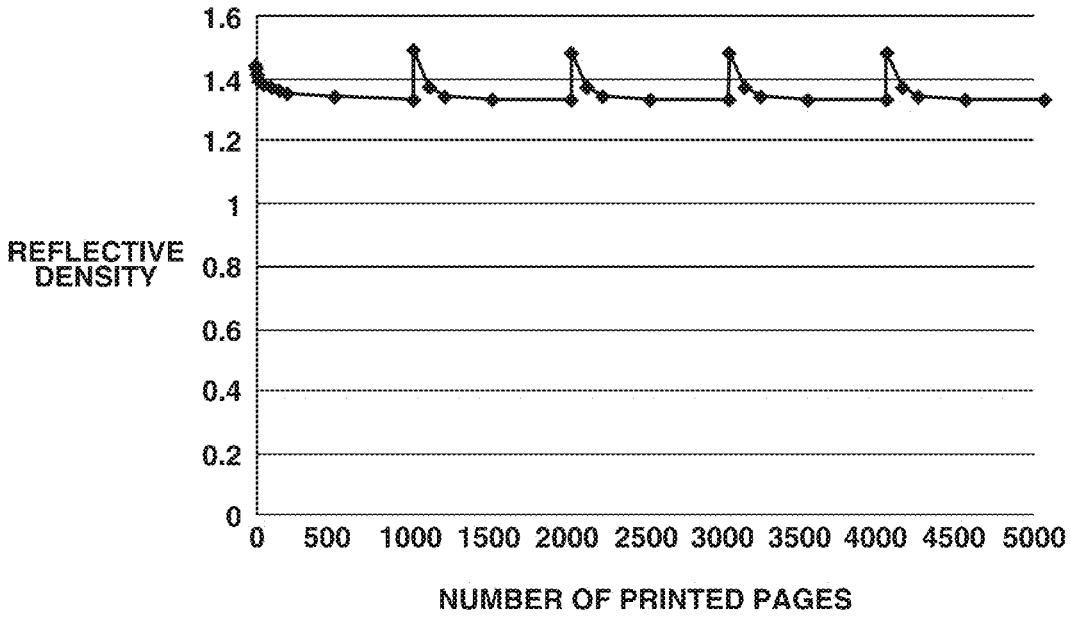
FIG. 11 is a transition diagram of an image density according to a comparative example.

Here, FIG. 11 illustrates, as an example, a density transition experienced when an image with a low printing rate (with a printing rate of 0.5% in the present exemplary embodiment) is continuously formed for 5000 pages under a certain environment. In FIG. 11, the image forming apparatus 100 performs the toner forcible discharge control, and then performs the image density control A (at a feedback rate of 30%).

In FIG. 11, the toner forcible discharge control is performed when the number of output pages has reached 1000. Since the toner forcible discharge control is followed by the supply of the development device 4 supplied with developer from the supply unit, the charge amount of developer contained in the development device 4 changes. At this time, the charge amount of developer is different from the charge amount before the toner forcible discharge control is performed. Thus, as illustrated in FIG. 11, the density of the image formed based on the image signal at the maximum signal level is higher than the target density (1.35). Thus, in a case where the toner forcible discharge control is performed and the development device 4 is supplied with toner from the supply unit subsequently, as illustrated in FIG. 11, it takes some time until an image with a desired density can be formed. For example, until the image is formed for 100 pages, the density of the image formed based on the image signal at the maximum signal level is higher than the target density.

In order to solve the above problem, the CPU 111 performs the image density control immediately after performing the toner forcible discharge control, and additionally increases the feedback rate in the image density control relative to the feedback rate in the image density control A. Even if a difference between the target density and the measured density is the same, the degree of correction with which the image signal is corrected using the gradation correction table corrected via the image density control B is lower than the degree of correction with which the image signal is corrected using the gradation correction table corrected via the image density control A. That is, the measured density is corrected to be closer to the target density in the image density control B than in the image density control A. Thereby, a change in density of the image can be reduced even if the charge amount of toner in the development device 4 changes as a result of the toner forcible discharge control being performed and the development device 4 subsequently being supplied with developer.

There will be described herein the feedback rate in the image density control A different from the feedback rate in the image density control B performed after the toner forcible discharge control is performed. The image density control A is performed each time the number of printed pages has reached 100. Thus, the gradation correction table is corrected at a high frequency. Therefore, when the feedback rate is set to be higher, the density will be corrected at a burst at a high frequency. Thereby, it is highly likely that color tone of the image in page 100 becomes different from color tone of the image in page 101.

The charge amount of developer in the development device 4 gradually changes along with the print operation. Thus, performing the image density control B at a high feedback rate when a change in density is small possibly results in correcting the density for a detection error of the photosensor 12 or an irregular density of a measurement image. In such a case, the density varies every time the image density control A is performed, which leads a situation in which a density of the image in page n is different from a density of the image in page n+1.

Therefore, the feedback rate in the image density control A is set at 30%, for example, and the gradation correction table is updated so as to enable density correction to be performed for 30% of the difference between a measurement density and the target density.

On the other hand, when the toner forcible discharge control is performed, the charge amount of toner largely changes. Thus, there is a possibility that a variation in density cannot be completely corrected if the feedback rate in the image density control B is the same as the feedback rate in the image density control A.

Therefore, the feedback rate in the image density control B which is performed after the toner forcible discharge control is set to be higher than the feedback rate in the image density control A. That is, the correction amount is larger at the feedback rate in the image density control B than at the feedback rate in the image density control A. A difference between an input image signal (input value) and an output image signal (output value) is larger in the gradation correction table created by the γ correction circuit 209 using the feedback rate in the image density control B than in the gradation correction table created by the γ correction circuit 209 using the feedback rate in the image density control A. The feedback rate in the image density control B is set at 100%, for example, and the gradation correction table is updated such that a difference between a measured density and the target density is corrected 100%.

Figure 12:
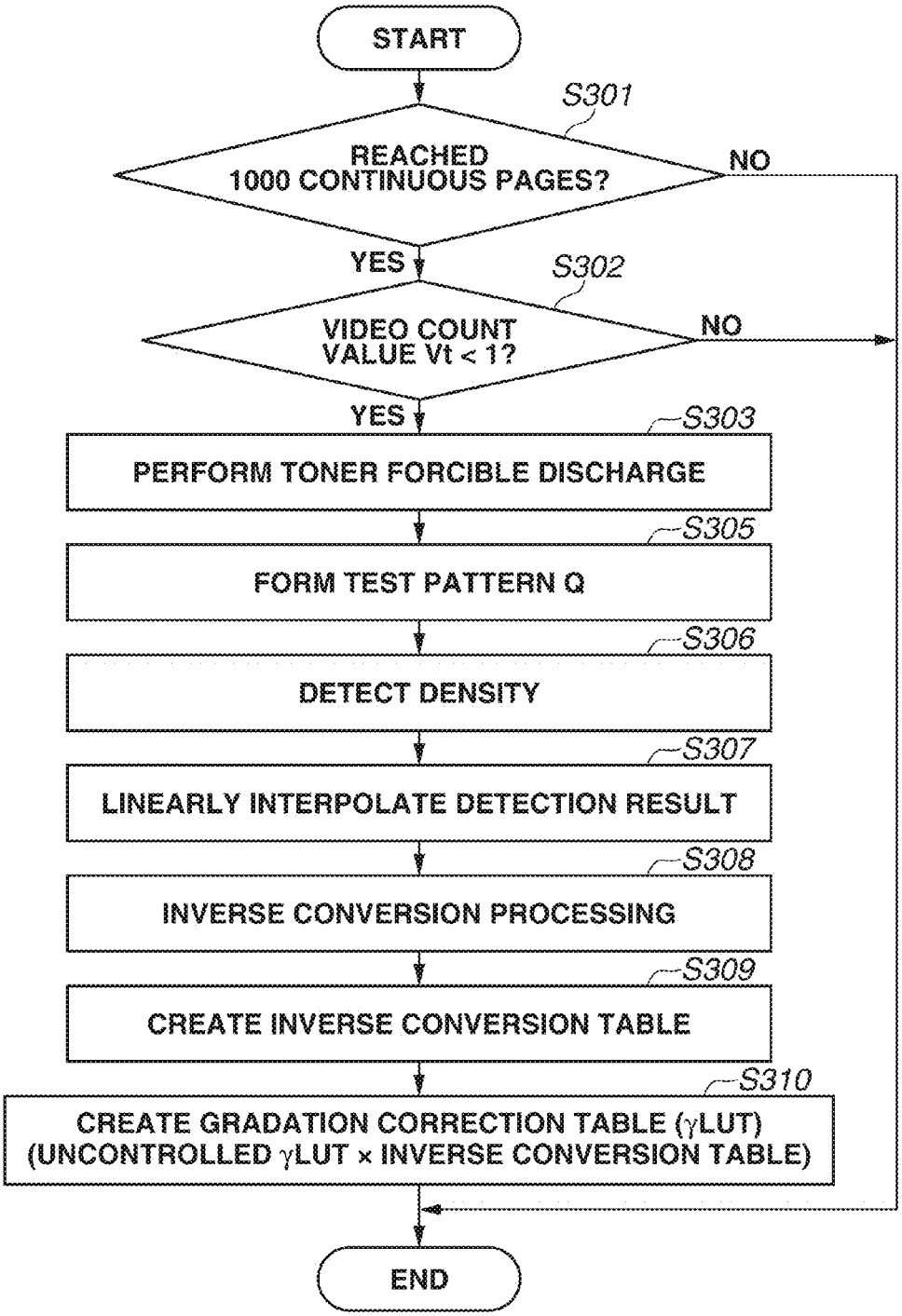
FIG. 12 is a flowchart illustrating image correction control including toner forcible discharge control.

A relationship between the toner forcible discharge control and the image density control B will be described with reference to FIG. 12. In step S301, the CPU 111 determines whether the number of printed pages has reached 1000. When the number of printed pages has reached 1000 (YES in step S301), in step S302, the CPU 111 determines whether to perform the toner forcible discharge control. When the video count value Vt is less than 1 (YES in step S302), the CPU 111 performs the toner forcible discharge control in step S303, and performs the image density control B in steps S305 to S310.

When the image density control B is performed, the CPU 111 corrects the measuring image data using the gradation correction table stored in the RAM 112, and in step S305, causes the image forming unit P to form a test pattern (measuring images Q) based on the corrected measurement image data on the photosensitive drum 1. The CPU 111 then measures a density of the measuring images Q using the photosensor 12 in step S306, and performs linear interpolation on results obtained by measuring each of measuring images in step S307.

The CPU 111 then makes inverse conversion calculation on the density target to enable the target density to be a proper density using the predictive density value and the target density value in step S308, and creates an inverse conversion table in step S309. In step S310, the CPU 111 corrects the gradation correction table using the inverse conversion table and the gradation correction table stored in the RAM 112.

Figure 13:
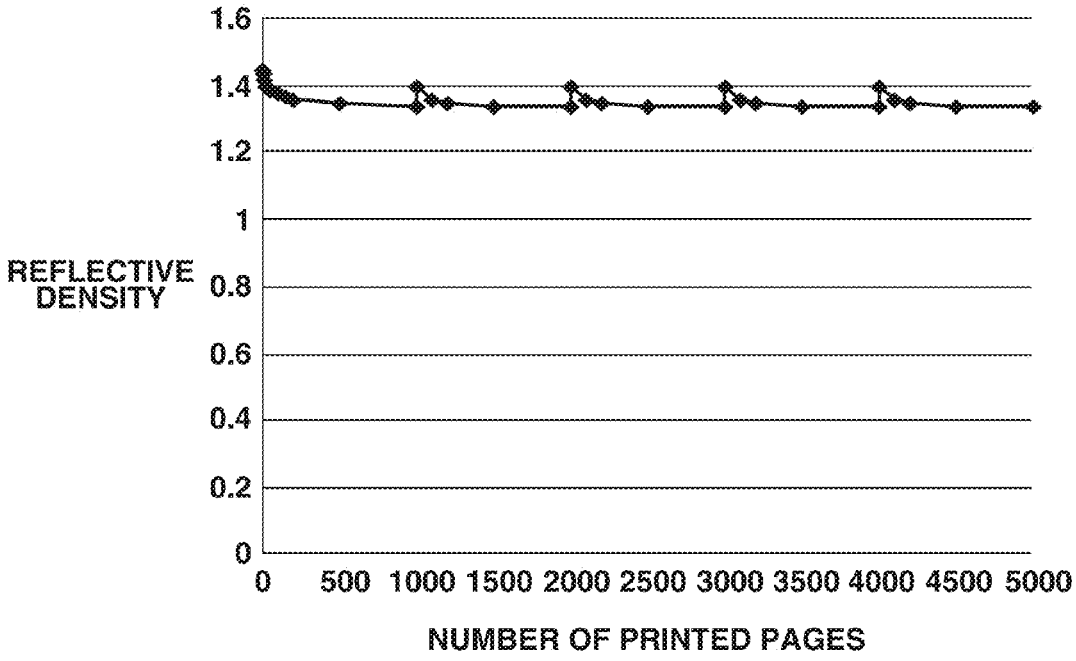
FIG. 13 is a transition diagram of an image density according to a first exemplary embodiment.

FIG. 13 is a diagram illustrating a transition in image density experienced when an image with a printing rate of 0.5% is continuously formed for 5000 pages. In FIG. 13, the image forming apparatus 100 performs the image density control B (at a feedback rate of 100%) after performing the toner forcible discharge control. The variation in image density between an image formed before the toner forcible discharge control is performed and an image formed after the toner forcible discharge control is performed is attenuated in FIG. 13 compared to that in the density transition experienced when the feedback rate is fixed at 30% illustrated in FIG. 11.

According to the present exemplary embodiment, the feedback rate in the image density control B is set to be higher than the feedback rate in the image density control A, which makes it possible to shorten a time required from when the toner forcible discharge control is performed until when an image with a desired density can be formed.

According to the first exemplary embodiment, the CPU 111 performs the image density control by applying a predetermined feedback rate (100%) when performing the toner forcible discharge control. In the present exemplary embodiment as a second exemplary embodiment, the CPU 111 changes the feedback rate in the image density control B depending on a video count value Vt.

This is because a variation amount of the charge amount of toner in the development device 4 is different depending on an average image printing rate. The feedback rate is set depending on a variation in the charge amount of toner in the development device 4 so that a difference in density between an image formed before the toner forcible discharge control is performed and an image formed after the toner forcible discharge control is performed can be reduced.

The feedback rate is determined based on the data indicating a correspondence between the video count value Vt and the feedback rate as illustrated in Table 1, for example. The data indicating the correspondence between the video count value Vt and the feedback rate is experimentally determined and is previously stored in the ROM 113. Here, the CPU 111 functions as a change unit that changes a correction coefficient using the data indicating the correspondence between the video count value Vt and the feedback rate.

TABLE 1

Relationship between video count Vt and feedback rate

| Video count Vt | Feedback rate(%) |
|---|---|
| 0 to 0.3 | 100 |
| 0.31 to 0.50 | 85 |
| 0.51 to 0.75 | 70 |
| 0.76 to 1.0 | 60 |

Figure 14:
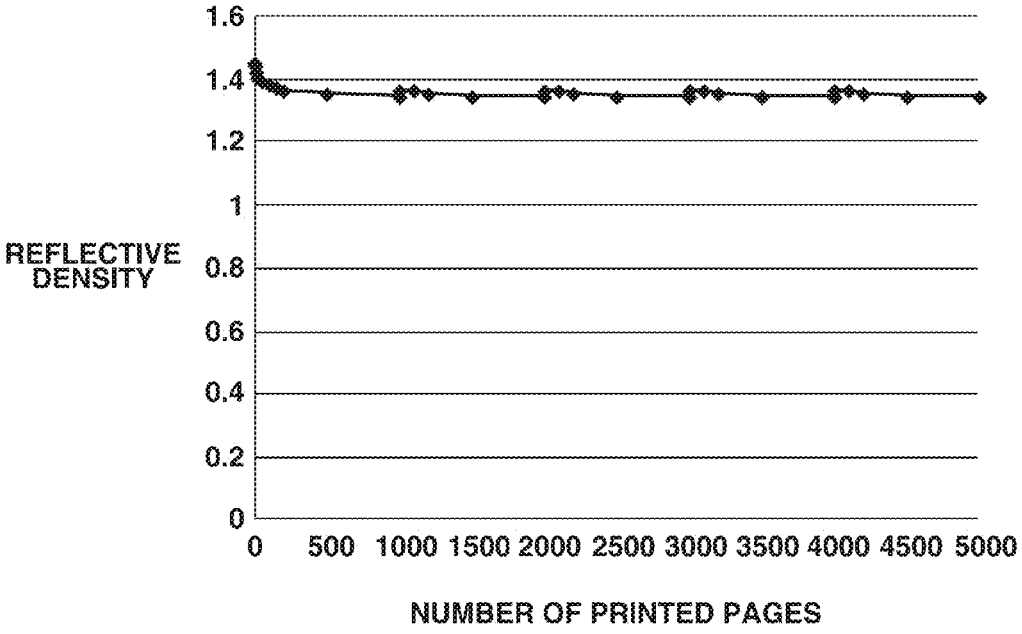
FIG. 14 is a transition diagram of an image density according to a second exemplary embodiment.

FIG. 14 is a diagram illustrating a transition in image density experienced when an image with a printing rate of 0.8% is continuously formed for 5000 pages. The variation in image density between an image formed before the toner forcible discharge control is performed and an image formed after the toner forcible discharge control is performed is further attenuated in FIG. 14 compared to those in the density transitions in FIG. 11 and FIG. 13. The feedback rate is set at 60%. Further, in FIG. 14, the differences in level of the density appearing in FIG. 13 are attenuated and the density of the image stably transits.

According to the present exemplary embodiment, the CPU 111 sets the feedback rate depending on an average printing rate, thereby enabling to restrict a control error and execute appropriate gradation correction corresponding to a change in the charge amount of toner.

According to the present exemplary embodiment, the image density control B with a higher feedback rate than the image density control A performed per predetermined pages is performed after the toner forcible discharge control is performed. Thus, it is possible to generate the gradation correction table suitable for the charge amount of developer.

According to the first and second exemplary embodiments, the photosensor 12 is configured to measure a density of a measuring image formed on the photosensitive drum 1, but may be configured to measure a density of a measuring image formed on the intermediate transfer belt 6.

Further, the first and second exemplary embodiments provides a configuration of having a pattern image used for discharging the developer cleaned by the cleaning device 8, but the pattern image may be cleaned by the cleaning device 68.

Further, according to the first and second exemplary embodiments, measuring images Q for five gradations are formed and measuring images R for 10 gradations are formed, but the number of measuring images is not limited thereto. The number of measuring images may be determined as needed.

While the present invention has been described with reference to exemplary embodiments, it is to be understood that the invention is not limited to the disclosed exemplary embodiments.

This application claims the benefit of Japanese Patent Application No. 2014-190114, filed Sep. 18, 2014, which is hereby incorporated by reference herein in its entirety.

What is claimed is:

1. An image forming apparatus comprising:

an image processor configured to convert image data based on a tone correction condition;

an image forming unit configured to form an image on a sheet based on the converted image data, wherein the image forming unit comprises:

a photosensitive member;

a latent image forming unit configured to form an electrostatic latent image on the photosensitive member; and a development unit configured to develop the electrostatic latent image by using a developer, a sensor configured to measure a measuring image formed by the image forming unit; and a controller configured to control the image forming unit to form a first measuring image, control the sensor to measure the first measuring image, and generate the tone correction condition based on a first measurement result of the first measuring image by the sensor and a first generating condition, wherein the controller further performs an adjustment process for adjusting a charge amount of the developer contained in the development unit, and wherein, in response to the adjustment process being performed, the controller controls the image forming unit to form a second measuring image and controls the sensor to measure the second measuring image, and generates the tone correction condition based on the measurement result of the second measuring image obtained by the sensor and a second generating condition that is different from the first generating condition.

2. The image forming apparatus according to claim 1, wherein the first generating condition is a first correction coefficient, the second generating condition is a second correction coefficient, and the second correction coefficient is larger than the first correction coefficient.

3. The image forming apparatus according to claim 1, wherein the controller controls the image forming unit to form a pattern image during the adjustment process and replenishes replenishment developer to the development unit.

4. The image forming apparatus according to claim 3, wherein the second generating condition is determined before the image forming unit forms the pattern image.

5. The image forming apparatus according to claim 3, wherein the pattern image is not transferred onto the sheet.

6. The image forming apparatus according to claim 3, wherein the controller controls whether or not to perform the adjustment process based on the image data.

7. The image forming apparatus according to claim 1, wherein the first generating condition corresponds to a first feedback rate and the second generating condition corresponds to a second feedback rate.

8. The image forming apparatus according to claim 7, wherein a difference between a gradation characteristic of an image which is formed by the image forming unit based on a tone correction condition generated by using the second feedback rate, and a target gradation characteristic is smaller than a difference between a gradation characteristic of an image which is formed by the image forming unit based on a tone correction condition generated by using the first feedback rate, and a target gradation characteristic.

9. The image forming apparatus according to claim 1, wherein, in a case where a number of sheets which the image forming unit formed an image thereonto reaches a predetermined number, the controller controls the image forming unit to form the first measuring image.

* * * * *